US005840423A

United States Patent [19]

Sano et al.

[11] Patent Number: 5,840,423

[45] Date of Patent: Nov. 24, 1998

[54] POLYVINYL ALCOHOL-BASED FIBER HAVING EXCELLENT HOT WATER RESISTANCE AND PRODUCTION PROCESS THEREOF

[75] Inventors: Hirofumi Sano, Kurashiki; Tomoyuki Sano, Okayama; Mitsuro Mayahara, Okayama; Yoshinori Hitomi, Okayama; Akira Shimizu, Kurashiki; Yusuke Ando, Kurashiki; Hiroshi Sumura, Kurashiki, all of Japan

[73] Assignee: Kuraray Co., Ltd., Kurashiki, Japan

[21] Appl. No.: 817,822

[22] PCT Filed: Aug. 14, 1996

[86] PCT No.: PCT/JP96/02293

§ 371 Date: May 5, 1997

§ 102(e) Date: May 5, 1997

[87] PCT Pub. No.: WO97/09472

PCT Pub. Date: Mar. 13, 1997

[30] Foreign Application Priority Data

Sep. 5, 1995 [JP] Japan ..... 7-227921

[51] Int. Cl.[6] ..... D02G 3/00

[52] U.S. Cl. ..... 438/364; 428/394

[58] Field of Search ..... 428/364, 394; 525/56

[56] References Cited

U.S. PATENT DOCUMENTS

| | | | |
|---|---|---|---|
| 5,229,057 | 7/1993 | Ohmory et al. | 264/185 |
| 5,238,995 | 8/1993 | Fukunishi et al. | 525/60 |
| 5,340,650 | 8/1994 | Hirakawa et al. | 428/373 |
| 5,380,588 | 1/1995 | Nishiyama et al. | 428/364 |
| 5,455,114 | 10/1995 | Ohmory et al. | 428/364 |

*Primary Examiner*—Newton Edwards
*Attorney, Agent, or Firm*—Oblon, Spivak, McClelland, Maier & Neustadt, P.C.

[57] ABSTRACT

A high-strength and highly wet-heat-resistant polyvinyl-alcohol-based fiber—in which the crosslinking agent has hardly been oxidized by the heat at the drawing time upon preparation of the fiber, the crosslinking agent has not exhaled so much at the time of dry heat drawing, and the crosslinking agent has penetrated even inside of the fiber so that not only the surface but also the inside of the fiber has sufficiently been crosslinked—can be obtained by the steps of: preparing a polyvinyl-alcohl-based fiber by spinning the polyvinyl-alcohol-based solution, wet drawing the fiber, applying an acetalization compound of an aliphatic dialdehyde having at least 6 carbon atoms to the fiber, subjecting the fiber which contains above compound to dry heat drawing to a total draw ratio of at least 15, and then crosslinking the drawn filament with an acid under mild crosslinking treatment conditions.

3 Claims, 1 Drawing Sheet

POLYVINYL ALCOHOL-BASED FIBER HAVING EXCELLENT HOT WATER RESISTANCE AND PRODUCTION PROCESS THEREOF

TECHNICAL FIELD OF THE INVENTION

This invention relates to a polyvinyl alcohol (hereinafter abbreviated as "PVA")-based fiber which has excellent hot water resistance because it has been sufficiently crosslinked not only on the fiber surface but also inside of the fiber. In particular, this invention is concerned with a PVA-based fiber which, owing to sufficient crosslinkage even inside of the fiber, hardly causes the dissolution of PVA from the end surface of the fiber and at the same time has a sufficient strength, when subjected to dyeing treatment in a hot water bath at a high temperature, or when subjected to steam curing in a high-temperature autoclave to heighten the strength of a cement product to which the fiber has been added as a reinforcing fiber.

BACKGROUND ART

A PVA-based fiber has the highest strength and the highest modulus of elasticity among general-purpose fibers and also has good adhesiveness and alkali resistance so that it has attracted attentions particularly as a cement reinforcing material substitutable for asbestos. It is, however, poor in hot water resistance (which will be also called "wet heat resistance") so that its applications have so far been limited even if it is employed as general industrial materials or materials for clothes. For example, when the PVA-based fiber is used for a cement product as a cement reinforcing material, it is accompanied with the problem that it cannot be subjected to autoclave curing at high temperature conditions. In the case where a PVA-based fiber is employed as a reinforcing fiber for a cement product, it is now the common but inevitable practice to subject the product to autoclave curing under heating conditions at room temperature or a low temperature. The autoclaving at such a low temperature also involves problems such as insufficiency in the size stability and strength of the resulting cement product and requirement for long curing days.

When the PVA-based fiber is used for mixed fabric products with a polyester-based fiber, a dyeing method commonly employed for the dyeing of a polyester fiber, in which dyeing is carried out in an aqueous solution at a high temperature of from 120° C. to 130° C. using a disperse dye, cannot be applied because of inferior hot water resistance of the PVA-based fiber. So, the use of the PVA-based fiber for clothes has been limited largely also from this viewpoint.

A carbon fiber has been used in some cases for autoclave curing at high temperatures but it is accompanied with a problem that it has inferior adhesiveness with cement matrix and thus produces only poor reinforcement effect and at the same time is expensive.

Attempts have been made to improve the wet heat resistance of a PVA-based fiber. For example, Japanese Patent Application Publication No. Sho 30-7360/1955 or Japanese Patent Application Publication No. Sho 36-14565/1961 describes that a PVA-based fiber is made hydrophobic by the crosslinking reaction (formalization) of hydroxyl groups of PVA by using formalin and that the fiber available by this method has sufficient hot water resistance against dyeing or washing. Such a PVA-based fiber, however, has not hot water resistance high enough to meet the level required by the present invention, that is, hot water resistance high enough to withstand high-temperature autoclave curing and moreover, it has a disadvantage in low strength.

Japanese Patent Application Laid-Open No. Sho 63-120107/1988 discloses a process which comprises formalizing a high strength PVA-based fiber. The fiber obtained by this process has however a formalization degree as low as 5–15 mole % and only very small part of the amorphous region of the fiber has been rendered hydrophobic so that the fiber available by this method has not sufficient hot water resistance and therefore cannot be used at all as an industrial material exposed in repetition to wet heat for a long period of time or as a cement reinforcing material subjected to high-temperature autoclave curing.

In Japanese Patent Application Laid-Open No. Hei 2-133605/1990 (corresponding to European Patent No. 351046 and U.S. Pat. No. 5,283,281) or Japanese Patent Application Laid-Open No. Hei 1-207435/1989, disclosed is a method in which hydroxyl groups of PVA are crosslinked by incorporating an acrylic-acid-based polymer in a PVA-based fiber or a method in which hot water resistance is improved by imparting an organic peroxide, isocyanate compound, urethane compound, epoxy compound or the like to the fiber surface, thereby crosslinking hydroxyl groups of PVA. The crosslinking reaction using an acrylic acid-base polymer is not successful because the crosslinkage formed by an ester bond readily hydrolyzes by an alkali in the cement and the acrylic-acid-based polymer loses its effect, while the latter method also involves a problem that during autoclave curing or when exposed in repetition to wet heat, swelling or dissolution starts appearing from the central region of the fiber, because the crosslinkage has occurred only on the surface of the fiber.

In addition, a method of improving wet heat resistance by conducting dehydration crosslinking using an acid is disclosed in Japanese Patent Application Laid-open No. Hei 2-84587/1990 or Japanese Patent Application Laid-open No. Hei 4-100912/1992. As a result of an additional test by the present inventors, however, it has been found that an attempt to conduct crosslinking even inside of the fiber causes severe decomposition of a PVA-based fiber, leading to the eminent lowering in the fiber strength.

The crosslinkage by a dialdehyde compound is clearly described in Japanese Patent Application Publication No. Sho 29-6145/1954 or Japanese Patent Application Publication No. Sho 32-5819/1957. According to the above description, the post treatment is conducted in a mixed bath containing a dialdehyde compound and, as a reaction catalyst, an acid, but the dialdehyde compound does not easily penetrate into the inside of the high strength PVA-based fiber having highly oriented and crystallized fiber molecules. It is therefore difficult to effect crosslinking inside of the fiber.

Japanese Patent Application Laid-Open No. Hei 5-163609/1993 discloses a process which comprises imparting a dialdehyde compound to a spinning fiber, conducting dry heat drawing at a high draw ratio, and treating with an acid, thereby causing crosslinkage inside of the resulting fiber. The specific examples of the dialdehyde compound described in the above literature include aliphatic dialdehyde compounds and aromatic dialdehyde compounds each having 6 or less carbon atoms. When an aliphatic dialdehyde having less carbon atoms is employed, the dialdehyde compound imparted to the spinning fiber is exhaled therefrom at the time of dry heat drawing and does not remain in the fiber sufficiently, leading to a problem that there does not exist sufficient crosslinkage (intermolecular crosslinkage) between PVA-based molecules which is effective for the attainment of hot water resistance. The use of an aromatic-based dialdehyde, on the other hand, is also accompanied with the problem that because it is an aromatic compound, it causes steric hindrance and prevents easy penetration into the fiber, and moreover lowering in the strength tends to occur. The above-disclosed method therefore cannot satisfy the both requirements for hot water resistance and high strength. In the above publication, it is described that when a dialdehyde compound having high reactivity is employed, it may be acetalized with an alcohol and as a representative example, a compound obtained by acetalizing malondialdehyde (an aliphatic dialdehyde having 3 carbon atoms) with methanol, that is, tetramethoxypropane is given. A dialdehyde compound having high reactivity generally has small carbon atoms such as malondialdehyde. Accordingly, an acetalization product of such a dialdehyde compound is accompanied with the problems that it tends to be exhaled from the fiber at the time of dry heat drawing, similar to the above case of a aliphatic dialdehyde compound, so that sufficient crosslinkage cannot be formed and moreover, in the case of the dialdehyde compound having small carbon atoms, intramolecular crosslinking tends to occur while intermolecular crosslinking necessary for the improvement of the heat resistance does not occur readily.

Finding that a PVA-based fiber which has been crosslinked even its inside and has excellent hot resistance can be obtained by having a dialdehyde compound, which is described in the above Japanese Patent Application Laid-Open No. Hei 5-163609/1993, penetrate into the inside of a PVA-based fiber which has been subjected to dry heat drawing, and immersing the resulting fiber in a bath containing a monoaldehyde and a crosslinking catalyst, thereby causing a crosslinking reaction; and that the PVA-based fiber so crosslinked can withstand autoclave curing at 160° C., the present applicant filed a patent. It is laid open as Japanese Patent Application Publication No. Hei 5-263311/1993 (corresponding to European Patent No. 520297 and U.S. Pat. No. 5,380,588). The above process surely makes it possible to produce a PVA-based fiber which has been crosslinked even its inside and has excellent hot water resistance. The process however causes a problem that since the dialdehyde compound has been imparted to the PVA-based fiber after the completion of dry heat drawing, that is, after the completion of its crystal orientation, the dialdehyde compound does not penetrate into the inside of the fiber sufficiently and when the fiber so obtained is subjected to autoclave curing at 170° C. or higher, the fiber will dissolve out.

In short, the processes known to date are accompanied with the following problems. In the case of the process in which a crosslinking agent is added to a fiber prior to dry heat drawing, that is, a fiber whose crystals have not been oriented yet, to have the crosslinking agent penetrate into the inside of the fiber, the crosslinking agent intentionally penetrated is exhaled from the fiber or is oxidized at the time of the subsequent dry heat drawing step and sufficient crosslinking reaction does not occur. While, in the case where a crosslinking agent is added after dry heat drawing, the crosslinking agent cannot penetrate into the inside of the fiber easily and sufficient crosslinkage is not formed inside of the fiber.

DISCLOSURE OF THE INVENTION

The present invention relates to a process capable of maintaining high strength of a fiber, causing intermolecular crosslinkage, which is effective for the improvement of hot water resistance, even inside of the fiber, substantially preventing the oxidation of a crosslinking agent caused by the heat at the time of dry heat drawing, and reducing the exhalation of the crosslinking agent at the time of drawing; and also a PVA-based fiber having high strength and high hot water resistance available by the method.

The present inventors have found that a PVA-based fiber having hot water resistance and high strength, which it has been impossible to produce by conventional techniques, can be produced by using a specific dialdehyde compound as a crosslinking agent and effecting crosslinking by a specific method, and completed the invention.

The present invention therefore provides a PVA-based fiber which has been crosslinked by an acetalization product of an aliphatic polyaldehyde having at least 6 carbon atoms and having an internal crosslinking index (CI) and tensile strength (DT) that can satisfy the following equations (1)–(3):

$$CI \geqq 86.5 - 2\times10^{-6}\times(DT)^{5.8} \quad (1)$$

$$CI \geqq 75 \quad (2)$$

$$DT \geqq 5 \text{ g/d} \quad (3)$$

The present invention also provides a process for producing a PVA-based fiber, which comprises the steps of:

preparing the PVA-based fiber by spinning a solution of a PVA-based polymer and then wet drawing, applying an acetalization product of an aliphatic polyaldehyde having at least 6 carbon atoms contain to the PVA-based fiber, subjecting the resulting fiber to dry heat drawing to give a tensile strength of 10 g/d or higher, and then treating in a bath of an aqueous sulfuric acid solution satisfying the following equation (4)

$$137/C^{0.05} - 52 \leqq T \leqq 137/C^{0.05} - 32 \quad (4)$$

wherein C means a sulfuric acid concentration (g/l) of the bath of an aqueous sulfuric acid solution and T means a treating temperature (°C.).

BRIEF DESCRIPTION OF THE DRAWINGS

In FIG. 1, also described are the values of the crosslinked PVA-based fiber available by the process disclosed in Japanese Patent Application Laid-Open No. Hei 5-263311/1993 (corresponding to European Patent No. 520297 and U.S. Pat. No. 5,380,588) and the value of the crosslinked PVA-based fiber available by the process disclosed in Japanese Patent Laid-Open No. Hei 2-133605/1990 (corresponding to European Patent No. 351046 and U.S. Pat. No. 5,283,281). From the results, it can be understood that the fiber according to the present invention has by far high internal crosslinkage and has excellent hot water resistance compared with the above-described crosslinked PVA-based fibers.

BEST MODE FOR CARRYING OUT THE INVENTION

Figure 1:
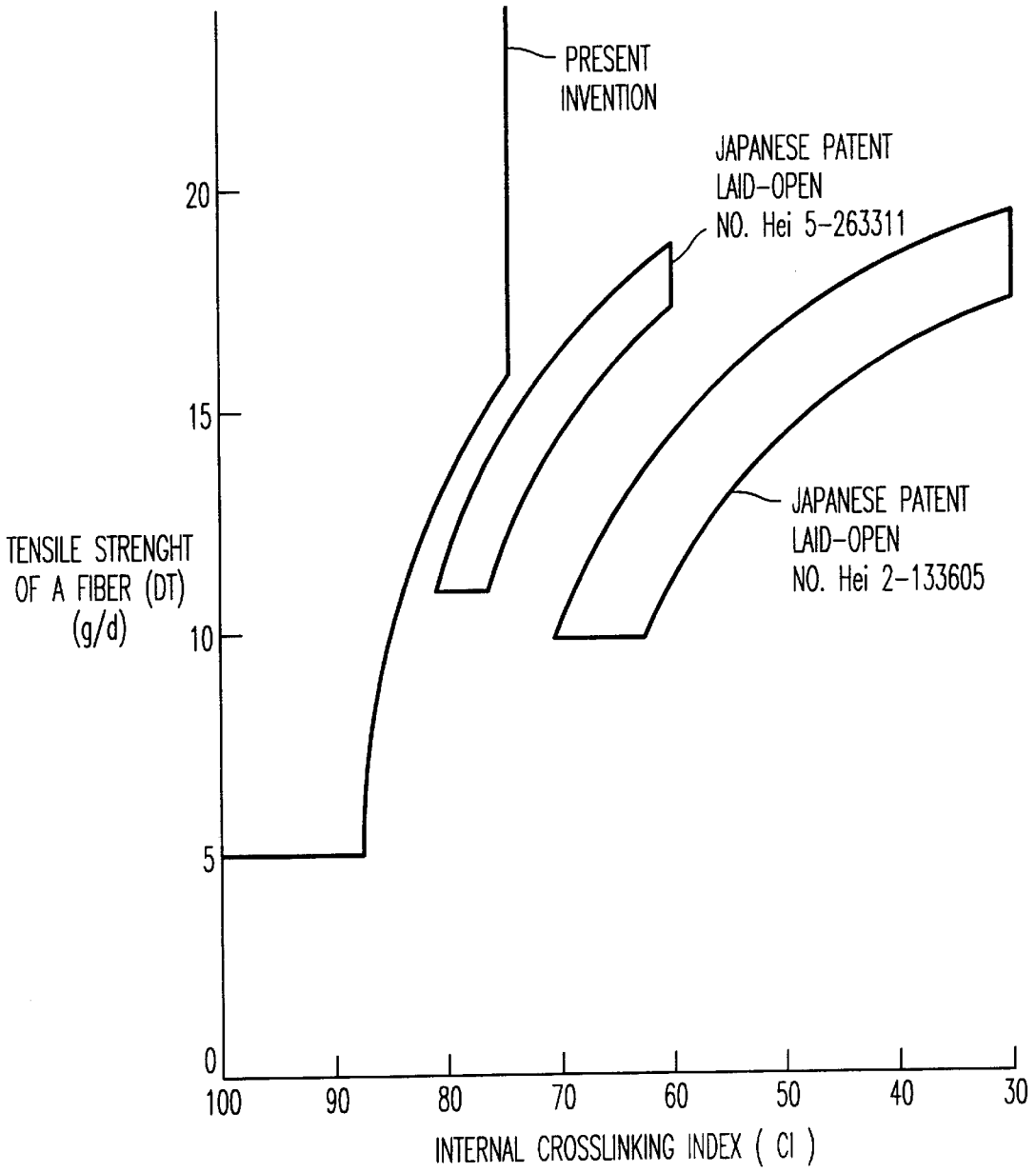
FIG. 1 is a diagram illustrating the relation between an internal crosslinking index (CI) and a tensile strength (DT) of a fiber as will be defined later in the present invention. In the diagram, the slashed portion corresponds to the scope of the present invention.

The present invention will hereinafter be described in further detail.

The term "a PVA-based polymer" as used here in means a PVA-based polymer having a viscosity-average polymerization degree of at least 1500 and a saponification degree of at least 98.5 mole %, preferably 99.0 mole %. The higher the average polymerization degree of the PVA-based polymer is, the more the tying molecules linking between the crystals and the less the number of the terminals of the molecules (an increase in the number of the molecules is disadvantageous). A higher average polymerization degree therefore makes it possible to attain high strength, high modulus of elasticity and high hot water resistance of the fiber and is therefore preferred. The average polymerization degree of at least 1700 is particularly preferred, with at least 2000 being more preferred. It is however difficult, in general, to prepare a PVA-based polymer having a polymerization degree exceeding 30000 and such a polymer is therefore not suited from the viewpoint of the industrial production.

The present invention also embraces, as PVA-based polymers, those modified by a modification unit such as ethylene, allyl alcohol, itaconic acid, acrylic acid, maleic anhydride or a ring-opened product of maleic anhydride, arylsulfonic acid, fatty acid vinyl ester such as vinyl pivalate or vinyl pyrrolidone, or the above-described ionic group partially or wholly neutralized. The modifying unit may be used in an amount of 2 mole % or smaller, with 1 mole % or smaller being more preferred.

For spinning of the PVA-based polymer, the PVA-based polymer is first dissolved in a solvent and then defoamed, whereby a spinning dope solution is prepared. Examples of the solvent usable here include polyhydric alcohols such as glycerin, ethylene glycol, diethylene glycol, triethylene glycol and butanediol, dimethyl sulfoxide, dimethylformamide, diethylenetriamine and water; and mixed solvents of at least two of them. Particularly, dimethyl sulfoxide, or a polyhydric alcohol such as glycerin or ethylene glycol is preferred because at the time when the spinning dope solution in such a solvent is poured in a coagulation bath, a uniform gel structure is formed and as a result, a high-strength fiber can be obtained.

To the spinning dope solution in which the PVA-based polymer has been dissolved in a solvent, it is possible to add boric acid, a surfactant, a decomposition inhibitor, various stabilizers, a dye and/or a pigment. Additives which impair the spinning property or drawing property are however not preferred.

The PVA-based polymer concentration in the spinning dope solution is preferably 5–50 wt. %. For the wet spinning method or dry-wet spinning method, 5–20 wt. % is preferred, while for the dry spinning method, 10–50 wt. % is preferred. As a temperature of the spinning dope solution, generally employed is 100°–230° C.

The spinning dope solution so obtained is spun in accordance with any one of the wet, dry and dry-wet method, followed by coagulation. In the wet or dry-wet spinning method, the spinning dope solution is coagulated into a fiber in a coagulation bath. Examples of the solution for the coagulation bath include alcohols such as methanol or ethanol, ketones such as acetone, methyl ethyl ketone or methyl isobutyl ketone, aqueous alkali solutions and aqueous solutions of an alkali metal salt, and mixtures thereof. To form a uniform gel structure by gradually conducting solvent extraction upon coagulation and thereby to attain higher strength and hot water resistance, it is preferred to add a solvent constituting the spinning dope solution to said coagulation bath solution in an amount of at least 10 wt. % and then mix them. In particular, it is preferred to use a 9:1 to 6:4 (weight ratio) mixed solvent of an alcohol represented by methanol and the solvent for the spinning dope. To obtain a gel having a uniform microcrystalline structure, that is, a high strength fiber, it is also preferred to reduce the temperature of the coagulation bath solution to 20° C. or lower, whereby the spinning dope solution discharged is quenched. It is more preferred to lower the temperature of the coagulation bath solution to 10° C. or lower to render the coagulation filament more uniform.

To prevent fusion adhesion between fibers and facilitate the subsequent dry heat drawing, it is desired to conduct wet drawing of so coagulated fiber at a draw ratio of at least 2 in a solvent-containing state. When the coagulation bath solution is an aqueous alkali solution or contains an alkali, neutralization under tension is preferred prior to wet drawing. Examples of the extracting medium employed in the next solvent extraction include primary alcohols such as methanol, ethanol and propanol; ketones such as acetone, methyl ethyl ketone, methyl propyl ketone and methyl isobutyl ketone; ethers such as dimethyl ether and methyl ethyl ether; and water. The fiber so extracted is then added with a lubricant as needed to dry the fiber. In the case of the dry spinning method, dry filament is produced by evaporating the solvent on and after the spinning time without using an extracting medium.

One of the greatest features of the present invention resides in that an acetalization product of an aliphatic dialdehyde having at least 6 carbon atoms is used as a crosslinking agent and such an acetalization product is added to a spinning filament in any one of the steps from spinning to drying to have the acetalization product penetrate into the inside of the spinning filament. Even by heating upon dry heat drawing, the acetalization product of an aliphatic dialdehyde having at least 6 carbon atoms is not exhaled much from the inside the fiber and it remains inside of the fiber after drawing, thereby bringing about crosslinkage sufficient to permit hot water resistance being able to withstand to autoclave curing at 170°–180° C. When such an acetalization product is added after drying the fiber, however, it does not easily penetrate into the inside of the fiber owing to a large molecular weight of the acetalization product, and crosslinkage occurs only on the surface of the fiber so that it is difficult to obtain a fiber having satisfactory hot water resistance.

In the present invention, based on the above-described findings, an acetalization compound of an aliphatic dialdehyde having at least 6 carbon atoms, said acetalization compound having a larger molecular weight compared with that of the conventionally employed crosslinking agent, is used as a crosslinking agent. Such a crosslinking agent is added to a spinning filament in any one of the steps from spinning to drying. As a result, and also owing to the specific crosslinking conditions which will be described later, it becomes possible to obtain a PVA-based fiber being able to withstand autoclave curing at 170°–180° C., which it has been impossible to produce by the conventional technique.

In the present invention, a particularly preferred method for imparting an acetalization product to the fiber is to add the acetalization product to an alcohol or ketone of extraction bath to dissolve the former in the latter and have the acetalization product to penetrate into the swollen-state filament which is just passing through the extraction bath. By this method, the acetalization product can penetrate into the inside of the fiber easily. In the present invention, it is accordingly preferred to employ, as a spinning method, a wet spinning method using an extraction bath or dry-wet spinning method.

Examples of the acetalization product of an aliphatic dialdehyde having at least 6 carbon atoms in the present invention include compounds each obtained by reacting a dialdehyde having at least 6 carbon atoms such as hexanedial, heptanedial, octanedial, nonanedial, decanedial, 2,4-dimethylhexanedial, 5-methylheptanedial or 4-methyloctanedial with an alcohol such as methanol, ethanol, propanol, butanol, ethylene glycol or propylene glycol to acetalize both ends or one end of the dialdehyde. The acetalization product has preferably a boiling point of 230° C. or higher, more preferably 260° C. or higher. When an aliphatic dialdehyde having more than 14 carbon atoms is used, crosslinking reaction does not occur easily and besides, orientation of the molecules is disturbed so that high strength cannot be attained. Such a dialdehyde is not therefore preferred. When an aliphatic dialdehyde has 5 carbon atoms or less, on the other hand, the acetalization product is exhaled at the time of dry heat drawing and a sufficient amount of the acetalization product does not remain inside of the fiber, which makes it impossible to prepare a PVA-based fiber having sufficient hot water resistance. Furthermore, in the case of such a dialdehyde, the acetalization product changes into its acid by the oxidation at the time of dry heat drawing and the resulting acid decomposes PVA or serves as a catalyst for the crosslinking reaction, thereby causing crosslinking reaction upon dry heat drawing, whereby the smooth drawing of the spinning filament is prevented and therefore sufficient strength cannot be attained. When such aliphatic dialdehydes outside the above range are used, the object of the present invention cannot be attained.

By the use of an acetalization product of a dialdehyde other than an aliphatic dialdehyde, for example, an acetalization product of an aromatic dialdehyde, the object of the present invention cannot be attained, because in this case, the steric hindrance prevents easy penetration of the acetalization product into the inside of the fiber and tends to induce a lowering in strength. If the product which has not been acetalized, that is, dialdehyde itself is used, a similar phenomenon as in the above case occurs. Described specifically, dialdehyde is oxidized into a corresponding carboxylic acid at the time of heat drawing and the resulting carboxylic acid decomposes PVA or causes a crosslinking reaction at the drawing time, which makes it difficult to conduct drawing at a high draw ratio and therefore to prepare a high strength fiber. The use of dialdehyde itself involves another problem in odor, because it is prone to exhale at the dry heat drawing time.

As described above, in the case when an aliphatic dialdehyde is used, it is oxidized by heat and oxygen under the dry heat drawing conditions and converts into a corresponding carboxylic acid, causes partial crosslinkage at the drawing time and fixes intermolecules of PVA, whereby a desired draw ratio cannot be attained and high-strength fiber cannot be obtained. Furthermore, smoke and/or decomposition gas emitted at the dry heat drawing time contaminates the working environment and becomes a problem. When the end group has been acetalized, oxidation hardly occurs at the dry heat drawing time and no such problems as described above arise. Particularly an acetalization product of an aliphatic dialdehyde having at least 6 carbon atoms is thermally stable and, different from the above case, is almost free from the exhalation of the dialdehyde at the time of dry heat drawing. Compared with the use of an aliphatic dialdehyde having at least 6 carbon atoms as a crosslinking agent, the use of its acetalization product enables the preparation of a high strength fiber having at least 1 g/d higher than the case of the non-acetalization product, though depending on the polymerization degree of the PVA-based polymer.

Specific examples of the particularly preferred acetalization product of an aliphatic dialdehyde having at least 6 carbon atoms include 1,1,9,9-tetramethoxynonane available by the reaction of 1,9-nonanedial with methanol and 1,9-nonanedial-bisethylene acetal available by the reaction of 1,9-nonanedial with ethylene glycol. These acetalization products are excellent in that they can prevent lowering in the strength of the fiber and form intermolecular crosslinkage effective for attaining hot water resistance. Among these compounds, those having both terminals acetalized are markedly stable against heat and therefore preferred.

In the present invention, the acetalization product is adhered to a dry-heat drawn filament in an amount of 0.3–10 wt. %, preferably 0.7–6 wt. %. When an amount is smaller than 0.3 wt. %, hot water resistance becomes insufficient owing to a low crosslinking density. An amount exceeding 10 wt. %, on the other hand, disturbs molecular orientation or promotes the decomposition of a PVA-based polymer, thereby tending to cause a lowering in the strength.

When the PVA-based fiber is used as a reinforcing fiber for high-temperature curing FRC, a spinning filament which contains the acetalization product and has already been subjected to drying treatment is subjected to dry heat drawing at a temperature not lower than 220° C. but not higher than 260° C., preferably not lower than 240° C. but not higher than 255° C. and at a whole draw ratio of at least 15, preferably 17 or higher. The term "whole draw ratio" as used herein means a value expressed by the product obtained by multiplying the draw ratio of wet drawing conducted prior to drying treatment by that of dry heat drawing. At a whole draw ratio less than 15, a high-strength fiber which is the object of the invention cannot be obtained. The drawing is carried out preferably at a wet draw ratio of 2–5 and at a dry heat draw ratio of 3–10.

Incidentally, for a PVA-based polymer having a higher polymerization degree, it is preferred to conduct dry heat drawing at higher temperatures. Temperatures exceeding 260° C., however, cause melting or decomposition of the PVA-based polymer so that they are not preferred. High strength as required for FRC is not needed when it is applied to clothes, but it is necessary to heighten the crosslinking degree and also to provide hot water resistance so that the resulting fiber can withstand the high-temperature dyeing in a free state (that is a state wherein the fiber can shrink freely). In this case, the drawing temperature is reduced by 5°–10° C. from the above-described one, by which the whole draw ratio becomes lower and molecular orientation and crystallization are suppressed. As a result, crosslinking tends to proceed more readily, and a fiber having markedly high hot water resistance can be provided.

The thus-drawn fiber containing the acetalization product of an aliphatic dialdehyde having at least 6 carbon atoms has a tensile strength of 10 g/d or higher. A tensile strength lower than 10 g/d is not preferred because the tensile strength of the fiber largely lowers by the crosslinking treatment which will be conducted later. More preferred is the case where the fiber has a tensile strength of 12 g/d or higher. In addition, the thus-drawn fiber containing the acetalization product of an aliphatic dialdehyde having at least 6 carbon atoms has preferably heat of crystal fusion of 130 joule/g or lower as measured by a differential thermal analysis. Since crystallization and orientation have generally proceeded in the high strength fibers, heat of crystal fusion tends to become high. Similarly in the case of the PVA-based fiber, high strength fiber has high heat of crystal fusion. The high strength PVA-based fiber has generally heat of crystal fusion of 135 joule/g or higher. The value of 130 joule/g or lower as specified in the present invention is slightly lower than that of the conventional high strength PVA-based fiber. It means that in the present invention, it is preferred to conduct crosslinking treatment with a PVA-based fiber having lower heat of crystal fusion than that of the conventional high strength PVA-based fiber. More preferred is a value not higher than 125 joule/g but not lower than 80 joule/g. A PVA-based fiber can be imparted with excellent hot water resistance by subjecting such a PVA-based fiber having low heat of crystal fusion to crosslinking treatment and thereby forming intermolecular crosslinkage sufficiently even inside of the fiber.

Described specifically, crosslinking treatment is conducted by immersing a drawn fiber, which contains the acetalization product of an aliphatic dialdehyde having at least 6 carbon atoms, in a bath of an aqueous sulfuric acid solution for 5–120 minutes. By this method, the reaction occurs between the hydroxyl group of the PVA-based polymer and the acetalization product, whereby intermolecular crosslinkage appears. Incidentally, the relation between the concentration (g/l) of sulfuric acid in the bath and the treating temperature (bath temperature) should satisfy the following equation (4):

$$137/C^{0.05}-52 \leqq T \leqq 137/C^{0.05}-32 \quad (4)$$

wherein C means a sulfuric acid concentration (g/l) of the bath of an aqueous sulfuric acid solution and T means a treating temperature (°C.).

Treating temperatures (T) lower than $137/C^{0.05}-52$ prevent sufficient progress of crosslinking, while those higher than $137/C^{0.05}-32$ bring about a large reduction in the strength. More preferred is the case which satisfies the following equation (5):

$$137/C^{0.05}-48 \leqq T \leqq 137/C^{0.05}-35 \quad (5)$$

Concerning the relationship between the sulfuric acid concentration and treating temperature as defined above in (4), either the sulfuric acid concentration or the treating temperature is lower than the conventionally and industrially adopted conditions for the acetalization of a PVA-based fiber. In the process according to the present invention, conditions different from the conventional ones are adopted as described above. It is possible to obtain a PVA-based fiber which has been crosslinked sufficiently even its inside and has surprisingly excellent hot water resistance capable of withstanding autoclave curing at 170° C. or higher by adopting such conditions and using a special crosslinking agent as described above. Furthermore, by the treatment with sulfuric acid at a high temperature and low concentration within a range as defined above in (4) makes it possible to prepare a fiber being able to withstand even dyeing at 120° C. in a free state. Incidentally, upon crosslinking treatment, sulfuric acid and formalin may be added to cause formalization at the same time. Moreover, a small amount of zinc chloride or a surfactant may be added to promote crosslinking.

In the present invention, it is desired to conduct the above-described crosslinking treatment after cutting the fiber into a predetermined length, for example, 15–100 mm in the case where the fiber is used as a staple and 2–15 mm in the case where the fiber is used as a short-cut fiber for reinforcement of cement, in order to heighten the hot water resistance of the fiber. When the fiber is cut after crosslinking, the crosslinking degree of the cut surface becomes lower than that of the circumferential portion of the fiber so that there is a fear of PVA dissolving out from the cut surface under severe wet heat conditions. The crosslinking treatment after cutting, on the other hand, does not cause the dissolution of PVA from the cut surface even under severe wet heat conditions, because sufficient crosslinking similar to the peripheral surface of the fiber is effected on the cut surface.

The PVA-based fiber obtained in accordance with the above method satisfies the following (1)–(3) at the same time.

$$CI \geqq 86.5-2\times10^{-6}\times(DT)^{5.8} \quad (1)$$

$$CI \geqq 75 \quad (2)$$

$$DT \geqq 5 \text{ g/d} \quad (3)$$

wherein CI represents an internal crosslinking index and DT represents a tensile strength of fiber.

If the resulting PVA-based fiber can satisfy neither (1) nor (2), it is very difficult for the fiber to withstand autoclave curing at 170° C. or higher or dyeing treatment at 120° C. in a free state. If it cannot satisfy the above equation (3), it loses the characteristics as a PVA-based fiber in the application to cement reinforcement where high strength is required or to clothes and consequently, it is of no utility value. The PVA-based fiber satisfying the following equations (6)–(8) is more preferred.

$$CI \geqq 90-2\times10^{-6}\times(DT)^{5.8} \quad (6)$$

$$CI \geqq 80 \quad (7)$$

$$DT \geqq 5 \text{ g/d} \quad (8)$$

Particularly the PVA-based fiber tends to cause shrinkage or dissolution by a dyeing treatment in a free state so that CI≧90 is desired. When the fiber is fixed in a cement as in autoclave, strength high enough to satisfy both equations of CI≧80 and DT≧14 g/d is preferred. It is however difficult to industrially produce a fiber which can satisfy both equations of CI>99 and DT>25 g/d.

The PVA-based fiber of the present invention which has been crosslinked is preferred to have heat of crystal fusion not higher than 105 joule/g as measured by differential thermal analysis. The value not higher than 105 joule/g means that the fiber has been crosslinked sufficiently and uniformly. When the heat of crystal fusion is higher than 105 joule/g, crosslinkage does not proceed into the inside of the fiber, which lowers its hot water resistance. More preferred is 100 joule/g or lower. A fiber having heat of crystal fusion lower than 50 joule/g is accompanied with the problem that its shrinkage factor in hot water increases, so that 50 joule/g or higher is preferred.

The PVA-based fiber available by the present invention can be used for high-temperature curing FRC, general industrial materials for which water resistance is required and clothes which can be subjected to high-temperature dyeing.

The present invention will hereinafter be described in detail by examples and comparative examples, in which all designations of "%" and "part" or "parts" mean wt. % and part or parts by weight unless otherwise specified. Values of various physical properties in the present invention are those measured according to the following methods.

1. Viscosity-average polymerization degree (P) of a PVA-based polymer

The specific viscosity (η sp) of each of five diluted aqueous solutions of a PVA-based polymer at 30° C. is measured in accordance with JIS K-6726. The intrinsic viscosity [η] is determined from the below-described equation (9) and the viscosity-average polymerization degree (P) is calculated in accordance with the below-described equation (10).

Incidentally, drawn uncrosslinked fiber is pressure dissolved in water not lower than 140° C. to give a concentration of 1–10 g/l. If the fiber is not dissolved completely and there appears a small amount of a gelled substance, the gelled substance is filtered off through a 5 μm glass filter and the viscosity of the resulting filtrate is measured. In addition, the concentration of the aqueous solution at this time is calculated using a correction value obtained by subtracting the weight of the remaining gelled substance from the weight of the sample.

$$[\eta]=\lim(c\rightarrow 0)\ \eta\ sp/c \quad (9)$$

$$P=([\eta]\times 10^4/8.29)^{1.613} \quad (10)$$

2. Content of an acetalization product of an aliphatic dialdehyde

The content of an acetalization product of an aliphatic dialdehyde is determined by dissolving a drawn uncrosslinked filament in deuterated dimethylsulfoxide not lower than 140° C. and calculating the peak area ratio of the acetalization product to the $CH_2$ group peak of the PVA-based polymer by NMR.

3. Internal crosslinking index (CI)

About 1 g of a sample is cut to 6 mm and weight $W_1$ is weighed. The cut sample is put into a pressure stainless pot, together with 100 cc of an aqueous solution of artificial cement (an aqueous solution in which 3.5 g/l of KOH, 0.9 g/l of NaOH and 0.4 g/l of $Ca(OH)_2$ have been dissolved). The pot is hermetically sealed, followed by treatment at 150° C. for 2 hours. The residue is collected by filtration through a filter paper, followed by drying. The weight $W_2$ of the residue is weighed and CI is calculated in accordance with the following equation:

$$CI=W_2/W_1\times 100$$

4. Heat of crystal fusion: Δ H (joule/g)

About 10 mg of a sample are weighed and charged in a open-type container in a free state. The measurement is conducted using "DSC-2C type" (trade name; product of Perkin Elmer Co., Ltd.) from room temperature to 280° C. in a nitrogen gas atmosphere at a heating rate of 10° C./min and Δ H (joule/1 g of sample) is determined from the area of crystalline fusion endothermic peak.

5. Tensile strength of fiber (gram/denier: g/d)

In accordance with JIS L-1015, a single fiber which has been moisture-conditioned in advance is adhered to a mount to give a sample length of 10 cm. It is allowed to stand at 25° C.×60% RH for 12 hours or more. Using a chuck for 2 kg in Instron 1122, breaking strength (that is, tensile strength) is determined at an initial load of 1/20 g/d and a pulling rate of 50%/min. An average value of n≧10 is adopted. Concerning denier (d), a single fiber is cut to 30 cm length under the load of 1/20 g/d and the denier is determined from an average value of n≧10 as measured by the gravimetric method. Using the single fiber after the measurement of denier, tensile strength is measured and the value of the tensile strength is corresponded to that of denier one by one. When the fiber is too short to be cut to 10 cm length, the maximum length is used as a sample length and measured in accordance with the above-described measuring conditions.

6. Autoclave resistance (wet bending strength WBS of slate)

A crosslinked PVA-based synthetic fiber is cut to 4–8 mm length. Using a Hatschek machine, a mixture containing 2 parts by weight of the fiber, 3 parts by weight of pulp, 38 parts by weight of silica and 57 parts by weight of cement is wet formed into a plate, which is subjected to primary curing at 50° C. for 12 hours and then autoclave curing under any one of the following conditions: at 150° C. for 20 hours, 160° C. for 15 hours, 170° C. for 15 hours and 180° C. for 10 hours, whereby a slate is prepared. The slate so obtained is immersed in water for 24 hours and then tested for bending strength in a wet state according to JIS K-6911.

7. Stable temperature (°C.) against hot water

Under no stretch, about 1 g of a crosslinked fiber or dishcloth and about 200 cc of water are charged in a minicolor dyeing machine (manufacture of Techsum Giken Co., Ltd.), followed by heating to 110° C. over 30 minutes. After treating at 5° C. intervals from 110° C. to 130° C. for 40 minutes each, the condition of the fiber is macroscopically judged and the maximum temperature of the fiber free from shrinkage or fusion adhesion between fibers is designated as stable temperature against hot water.

EXAMPLES 1 AND 2 AND COMPARATIVE EXAMPLES 1 AND 2

PVA having a viscosity-average polymerization degree of 1,700 (Example 1) or 3,500 (Example 2) and having a saponification degree of 99.5 mole % was dissolved in dimethylsulfoxide (DMSO) at 110° C. to give a concentration of 15 wt. % (Example 1) or 11 wt. % (Example 2). The solution so obtained was discharged from a nozzle having 1000 holes, followed by wet spinning in a coagulation bath of 7° C. composed of methanol and dimethylsulfoxide at a weight ratio of 6:4. After wet drawing to a draw ratio of 4 in a methanol bath of 40° C., almost all the solvents were removed using methanol. To the final methanol extraction bath, 1,1,9,9-tetramethoxynonane, which had been obtained by methoxylation of aldehydes at both ends of 1,9-nonanedial and had a boiling point of about 300° C., was added to give a concentration of 4 wt. %/bath and the resulting mixture was made uniform. The fiber was then retained in the uniform solution for 1.5 minutes to have the acetalization product contain inside or on the surface of the methanol-containing fiber, followed by drying at 120° C. The filament so obtained was subjected to dry heat drawing in a hot-air oven formed of three sections at 170° C., 200° C. and 230° C. to a total draw ratio of 17.2 in the case of Example 1 or dry heat drawing in a hot-air oven formed of three sections at 170° C., 210° C. and 240° C. to a total draw ratio of 17.5 in the case of Example 2, whereby a multi-filament of about 1800 denier/1000 filaments was obtained. The drawn filament was then immersed in a 70° C. aqueous solution of 20 g/l of sulfuric acid for 30 minutes to cause crosslinking reaction (when C=20 g/l and T=70° C., $137/C^{0.05}$=117.9° C.).

In Example 1 or 2, smoking and odor were hardly observed at the time of dry heat drawing so that there were no problems at all in the working environment.

In Comparative Example 1, in a similar manner to Example 1 except for 1,9-nonanedial having a boiling point of about 240° C. was used instead of 1,1,9,9-tetramethoxynonane, drawing was effected. As a result, the total draw ratio was reduced to 16.5, which was considered to be caused by the acidification of the solution of the methanol extraction bath owing to the conversion of a portion of 1,9-nonanedial into a corresponding carboxylic acid at the time of drawing. In addition, smoking and odor were observed at the time of drawing, which was a problem in the working environment.

In Comparative Example 2, in a similar manner to Example 2 except that a drawn filament (total draw ratio of 17.5) free from 1,1,9,9-tetramethoxynonane was used instead, multi-filament was prepared. Then the filament was immersed in an aqueous solution containing 100 g/l of formalin and 80 g/l of sulfuric acid at 80° C. for 60 minutes to cause formalization reaction. For the evaluation using a slate, each crosslinked filament was cut to 6 mm.

Average polymerization degree and physical properties of the fibers obtained above in Examples and Comparative Examples are shown in Table 1.

TABLE 1

| | | Ex. 1 | Ex. 2 | Comp. Ex. 1 | Comp. Ex. 2 |
|---|---|---|---|---|---|
| PVA polymerization degree | | 1700 | 3500 | 1700 | 3500 |
| Content of crosslinking agent (%) | | 2.4 | 2.0 | 1.1 | — |
| Heat of crystal fusion of fiber before crosslinking (joule/g) | | 125 | 128 | 124 | 128 |
| Tensile strength before crosslinking (g/d) | | 16.5 | 19.2 | 15.1 | 19.5 |
| Tensile strength after crosslinking (DT g/d) | | 14.7 | 17.5 | 13.4 | 14.8 |
| $(DT)^{5.8}$ ($\times 10^6$) | | 5.89 | 16.2 | 3.45 | 6.13 |
| Internal crosslinking index (CI) | | 82.2 | 84.9 | 70.1 | 51.5 |
| Heat of crystal fusion of fiber after crosslinking (joule/g) | | 101 | 94 | 110 | 119 |
| WBS | 150° C. | 294 | 340 | 270 | 191 |
| ($kg/cm^2$) | 160° C. | 266 | 328 | 195 | * |
| | 170° C. | 225 | 319 | * | * |
| | 180° C. | 160 | 261 | * | * |

An asterisk (*) means that the value is less than 150 $kg/cm^2$ and that the addition of a reinforcing fiber brought about no effect.

EXAMPLE 3 AND COMPARATIVE EXAMPLE 3

A PVA-based polymer having a viscosity-average polymerization degree of 8000 and a saponification degree of 99.9 mole % was dissolved in ethylene glycol at 170° C. to a concentration of 8 wt. %. The solution so obtained was discharged from a nozzle having 400 holes, followed by quenching and gelation in accordance with the dry-wet spinning method in a coagulation bath of 0° C. composed of methanol and ethylene glycol at a 7:3 ratio. After wet drawing at a draw ratio to 4 in a methanol bath of 40° C., almost all the solvents were removed by methanol. To the final methanol extraction bath, 1,9-nonanedial-bisethyleneacetal which had been obtained by acetalization of aldehydes at both ends of 1,9-nonanedial with ethylene glycol and had a boiling point of about 330° C. was added to a concentration of 8 wt. %/bath, which was then made into a uniform solution. The fiber was then retained in the uniform solution so obtained for 2 minutes to have the acetalization compound contain inside and on the surface of the fiber, followed by drying at 130° C.

The spinning dope so obtained was drawn to a total draw ratio of 19.4 in a radiation furnace formed of two sections at 180° C. and 248° C., respectively, whereby a multi-filament composed of a 1000 d/400 filaments having a viscosity-average polymerization degree of 8200 and a content of the acetalization compound of 3.7% was obtained. After the drawn filament was cut to 6 mm, it was immersed in an aqueous solution of 75° C. ($137/C^{0.05}$=122.1) containing 10 g/l of sulfuric acid for 30 minutes, whereby crosslinking reaction proceeded. The crosslinked fiber so obtained had an internal crosslinking index of 85.6 and a tensile strength of 19.5 g/d [$(DT)^{5.8}=30.4\times10^6$]. Even by autoclave treatment at 180° C., it had WBS of 295 $kg/cm^2$ and thus exhibited excellent performance. In addition, at the time of thermal drawing treatment, there happened neither smoking nor odor so that the working environment was free of pollution.

In Comparative Example 3, in a similar manner to Example 3 except that phosphoric acid was added to 0.05 wt. %/bath instead of 1,9-nonanedial-bisethyleneacetal, dry heat drawing was conducted, whereby a fiber containing only acid crosslinkage was obtained. The fiber so obtained had an internal crosslinking index of 47.8 and a tensile strength of 16.9 g/d, which were much inferior to the results of Example 3.

EXAMPLE 4 AND COMPARATIVE EXAMPLES 4–5

In a similar manner to Example 2 except that 1,1,6,6-tetramethoxyhexane (boiling point: about 350° C.) available by acetalizing aldehydes at both ends of 1,6-hexanedial with methanol, was used instead of 1,1,9,9-tetramethoxynonane in an amount of 5 wt. %, a crosslinked PVA fiber was obtained (Example 4). Also in this example, smoking and odor were hardly observed at the time of dry heat drawing and there were no problems at all in the working environment.

In a similar manner to Example 2 except that 1,1,3,3-tetramethoxypropane (boiling point: about 185° C.) available by acetalizing aldehydes at both ends of malonaldehyde with methanol, was used instead of 1,1,9,9-tetramethoxynonane in an amount of 5 wt. %, a crosslinked PVA fiber was obtained (Comparative Example 4).

In a similar manner to Example 2, except that 1,1,5,5-tetramethoxypentane (boiling point: about 250° C.) available by acetalizing both ends of glutaraldehyde with methanol, was used instead of 1,1,9,9-tetramethoxynonane in an amount of 5 wt. %, a crosslinked PVA fiber was obtained (Comparative Example 5).

Physical properties of the fibers obtained in those example and comparative examples are shown in Table 2.

TABLE 2

| | Ex. 4 | Comp. Ex. 4 | Comp. Ex. 5 |
|---|---|---|---|
| PVA polymerization degree | 3500 | 3500 | 3500 |
| Content of crosslinking agent (%) | 3.5 | 2.1 | 3.2 |
| Heat of crystal fusion of fiber before crosslinking (joule/g) | 128 | 128 | 128 |
| Tensile strength before crosslinking (g/d) | 18.5 | 18.3 | 18.1 |
| Tensile strength after crosslinking (DT g/d) | 16.1 | 15.5 | 15.3 |
| $(DT)^{5.8}$ ($\times 10^6$) | 9.99 | | |
| Internal crosslinking index (CI) | 83.9 | 71.1 | 72.5 |

TABLE 2-continued

| | | Ex. 4 | Comp. Ex. 4 | Comp. Ex. 5 |
|---|---|---|---|---|
| Heat of crystal fusion of fiber after crosslinking (joule/g) | | 98 | 115 | 110 |
| WBS ($kg/cm^2$) | 150° C. | 328 | 289 | 291 |
| | 160° C. | 321 | 266 | 280 |
| | 170° C. | 306 | 209 | 210 |
| | 180° C. | 242 | 172 | 165 |

EXAMPLE 5

A completely saponified PVA having a viscosity-average polymerization degree of 4000 was dissolved in DMSO to a concentration of 12%. The solution so obtained was discharged from a nozzle having 400 holes and was subjected to wet spinning in a coagulation bath of 7° C. composed of methanol and DMSO at a weight ratio of 7:3. After wet drawing to a draw ratio of 4 in a methanol bath, almost all the solvents were removed using methanol. To the final methanol extraction bath, 1,1,9,9-tetramethoxynonane was added to a concentration of 5 wt. %/bath to have the acetalization product contain inside and on the surface of the fiber, followed by drying at 120° C. The spinning fiber so obtained was subjected to dry heat drawing to a total draw ratio of 16.0 in a hot air oven formed of three sections of 170° C., 200° C. and 235° C., whereby a multi-filament composed of 1500 denier/400 filaments was prepared. The drawn filament had heat of crystal fusion of 122 joule/g, tensile strength of 17.2 g/d and a tetramethoxynonane content of 3.9 wt. %. The drawn filament was then cut to 8 mm and crosslinking reaction was caused by treating it with 80 g/l [$(80)^{0.05}$=1.245] of sulfuric acid at 70° C. for 20 minutes. The crosslinked filament so obtained had heat of crystal fusion of 90 joule/g, internal crosslinking index of 88.4 and a tensile strength of 14.1 g/d [$(DT)^{5.8}=4.63\times10^6$]. After autoclave treatment at 180° C., a high strength PVA-based fiber having WBS of 256 $kg/cm^2$ and therefore having high wet heat resistance was obtained. Also in this example, smoking and odor were hardly observed at the time of dry heat drawing and there were no problems at all in the working environment.

EXAMPLE 6 AND COMPARATIVE EXAMPLES 6 AND 7

PVA having a viscosity-average polymerization degree of 1700 and a saponification degree of 99.5 mole % was dissolved in DMSO at 100° C. to a concentration of 17 wt. %. The solution so obtained was discharged from a nozzle having 0.12ϕ mm×60 holes, followed by wet spinning in a coagulation bath of 10° C. composed of methanol and DMSO at a weight ratio of 7:3. After wet drawing to a draw ratio of 3.5 in a methanol bath at 40° C., 1,1,9,9-tetramethoxynonane was added to a final methanol extraction bath to give a concentration of 2 wt. %/bath, followed by drying at 120° C. The spinning dope so obtained was drawn to a total draw ratio of 10 in a radiation furnace formed of two sections of 170° C. and 200° C., respectively, whereby a multi-filament of 195 denier/60 filaments was obtained. The drawn filament had heat of crystal fusion of 115 joule/g, tensile strength of 12.6 g/d and a tetramethoxynonane content of 1.3 wt. %. The filament was then twisted at 80 T/m and then, in the form of a hank, charged in a minicolor dyeing machine [$(1.5)^{0.05}$=1.02] so that its bath ratio to a water dispersion containing 5 g/l of tetramethoxynonane, 1.5 g/l of sulfuric acid and 0.5 g/l of sodium dodecylbenzenesulfonate be 1:50. After heating from 60° C. to 98° C. over one hour, crosslinking treatment was conducted at the temperature for 30 minutes, followed by washing with water and then drying at 60° C. The crosslinked filament was reduced in heat of crystal fusion to 81 joule/g, and it had a CI of 91.8 which showed that the crosslinkage proceeded into the inside of the fiber. The tensile strength was lowered to 9.1 g/d [$(DT)^{5.8}=0.365\times10^6$], however, it was found that the fiber was usable for clothes at 120° C., which is a stable temperature against hot water, under free stretch. Also in this example, smoking and odor were hardly observed at the time of dry heat drawing and there were no problems at all in the working environment.

In Comparative Example 6, in a similar manner to Example 5 except that the sulfuric acid concentration was changed to 20 g/l ($137/20^{0.05}$=117.9) and the temperature of the treatment bath was changed to 98° C., crosslinking treatment was conducted. In Comparative Example 7, in similar manner except that the sulfuric acid concentration was changed to 10 g/l ($137/10^{0.05}$=122.1) and the temperature of the treatment bath was changed to 110° C. crosslinking treatment was conducted. In Comparative Example 6 where the sulfuric acid concentration was relatively high considering the physical properties of the fiber, CI was 94.1 and tensile strength (DT) was 4.5 g/d. In Comparative Example 7 where the treatment bath temperature was relatively high for the sulfuric acid concentration so that concerning physical properties of the fiber, CI was 95.2 and tensile strength (DT) was 3.8 g/d.

Capacity of Exploitation in the Industry

In the present invention, an acetalization product of an aliphatic dialdehyde having at least 6 carbon atoms, which is used as an acetalization agent, has a high boiling point so that exhalation, odor or thermal decomposition does not occur at the time of thermal drawing. By having the acetalization agent penetrate even into the inside of the fiber prior to thermal drawing and causing intermolecular crosslinkage under relatively mild crosslinking treatment conditions after thermal drawing, the PVA-based fiber can acquire high strength and excellent wet heat resistance, which it has been impossible to provide by conventional techniques.

The fiber according to the present invention can be used widely not only in the fields of general industrial materials such as rope, fishing net, tent or sheet for construction work, but also in the fields of a reinforcing fiber for autoclave-cured cement which is subjected to high-temperature autoclave curing, and in the fields of a raw material for clothes which is mixed spun with a polyester fiber and is subjected to high-temperature dyeing with a disperse dye or the like.

What is claimed is:

1. A polyvinyl alcohol-based fiber which has been crosslinked by an acetalization product of an aliphatic polyaldehyde having at least 6 carbon atoms and having an internal crosslinking index (CI) and tensile strength (DT) which satisfy the following equations (1)–(3):

$$CI \geqq 86.5-2\times10^{-6}\times(DT)^{5.8} \quad (1)$$

$$CI \geqq 75 \quad (2)$$

$$DT \geqq 5 \text{ g/d.} \quad (3)$$

2. A polyvinyl alcohol-based fiber according to claim 1, wherein the acetalization product of an aliphatic polyaldehyde having at least 6 carbon atoms is an acetalization product of nonanedial.

3. A polyvinyl alcohol-based fiber according to claim 1, wherein heat of crystal fusion as measured by differential thermal analysis is 105 joule/g or lower.

* * * * *